US009052633B2

(12) United States Patent
Tatebe et al.

(10) Patent No.: US 9,052,633 B2
(45) Date of Patent: Jun. 9, 2015

(54) EXPOSURE DEVICE AND IMAGE FORMING APPARATUS

(71) Applicants: Tetsuro Tatebe, Osaka (JP); Takashi Michiyoshi, Osaka (JP)

(72) Inventors: Tetsuro Tatebe, Osaka (JP); Takashi Michiyoshi, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/174,943

(22) Filed: Feb. 7, 2014

(65) Prior Publication Data

US 2014/0253657 A1 Sep. 11, 2014

(30) Foreign Application Priority Data

Mar. 7, 2013 (JP) ..... 2013-045869

(51) Int. Cl.
*G03G 13/04* (2006.01)
*G03G 15/04* (2006.01)

(52) U.S. Cl.
CPC ..... *G03G 13/04* (2013.01); *G03G 15/04054* (2013.01)

(58) Field of Classification Search
CPC ..... G03G 13/04; G03G 15/04054; B41J 2/45
USPC ..... 347/118, 122, 130
See application file for complete search history.

(56) References Cited

U.S. PATENT DOCUMENTS 5,703,436 A * 12/1997 Forrest et al. ..... 313/506
7,432,945 B2 * 10/2008 Kobayashi ..... 347/238

FOREIGN PATENT DOCUMENTS

JP 08-174903 7/1996
JP 2006-187895 7/2006
JP 4552601 9/2010

* cited by examiner

*Primary Examiner* — Alessandro Amari
*Assistant Examiner* — Michael Konczal
(74) *Attorney, Agent, or Firm* — Cooper & Dunham LLP

(57) ABSTRACT

An exposure device, which emits light according to a gray level of image data, includes plural light emitting element lines arranged at different positions in a sub scanning direction, a number of the light emitting element lines being a number of bits representing a number of gray levels. Each of the light emitting element lines includes plural light emitting elements arranged in a line in a direction parallel to a main scanning direction, the light emitting elements numbers of layers of organic electro-luminescence light emitting elements being the same. The numbers of layers of the organic electro-luminescence light emitting elements laminated in the light emitting element lines, which are arranged at different positions in the sub scanning direction, are different from each other.

7 Claims, 11 Drawing Sheets

FIG.2

| 21-1 (EXPOSURE AMOUNT 1) | 21-2 (EXPOSURE AMOUNT 2) | 21-3 (EXPOSURE AMOUNT 4) | GRAY LEVEL |
|---|---|---|---|
| OFF | OFF | OFF | 0 |
| ON | OFF | OFF | 1 |
| OFF | ON | OFF | 2 |
| ON | ON | OFF | 3 |
| OFF | OFF | ON | 4 |
| ON | OFF | ON | 5 |
| OFF | ON | ON | 6 |
| ON | ON | ON | 7 |

211
203A
203
203
203

EXPOSURE DEVICE AND IMAGE FORMING APPARATUS

BACKGROUND OF THE INVENTION

1. Field of the Invention

The disclosures herein generally relate to an exposure device, which causes a light-emitting element to emit light according to a gray level of image data, and an image forming apparatus.

2. Description of the Related Art

Electro-photographic printers, which are often called laser printers, are widely used in companies and in homes, and for commercial printing. A laser printer includes a photoreceptor drum as an exposure unit, around the periphery of which a charge unit, an exposure device, a development unit and a transfer unit are arranged adjacent to each other. By selectively exposing, by the exposure device, the periphery of the photoreceptor drum, which is charged by the charge unit, an electrostatic latent image is formed. The latent image is developed with toner provided from the development unit. Then, the toner image, developed with the toner, is transferred to a paper or on to a transfer belt, by the transfer unit.

As the exposing method in the laser printer, a method of reflecting a laser light from a laser diode onto a polygon mirror, and exposing the periphery of the drum to the laser light by one line in a main scanning direction, and another method of exposing the periphery of the drum to the light of an LED (Light Emitting Diode) array of one line, arranged in the main scanning direction, by one line, are known. The latter method is called the LED array type. According to the recent developments of the characteristics of the LED and the technology in manufacturing the LED, the exposure devices of the LED array type have been actively developed. However, in the LED array type exposure device, the LEDs are arranged in a staggered arrangement in two columns. In such an exposure device, thousands of emitting points are required to be arranged with high accuracy. There is a problem that reducing the production cost of the exposure device is difficult.

Recently, an image forming apparatus, in which an organic EL (Electro Luminescence) emitting element is employed for the light emitting element in the exposure device, has been proposed. The organic EL light emitting element has a feature that the emitting point can be fabricated with high accuracy. However, luminance of the organic EL light emitting element is quite low compared with the LED. Accordingly, a light quantity from the exposure device, including the organic EL light emitting element, is insufficient for the exposure in the laser printer.

In order to solve the above problem, Japanese Patent No. 4552601 and Japanese Published Patent Application No. 2006-187895 disclose a multiple exposure by organic EL light emitting elements.

FIG. 10A is a diagram schematically showing the exposure device disclosed in Japanese Patent No. 4552601. In the exposure device 211 shown in FIG. 10A, ten lines, in the sub scanning direction (Y axis direction), of light emitting elements are formed. Between the even-numbered line and the odd-numbered line, the organic EL light emitting elements 203 are arranged in a staggered manner. That is, the exposure device shown in FIG. 10A includes five groups, each of which has the organic EL light emitting elements arranged in a staggered manner. The organic EL light emitting elements in respective groups and on the same column can expose the same drawing point on the photoreceptor drum. Accordingly, the drawing point on the photoreceptor drum can be exposed five times at the maximum.

FIG. 10B is a diagram schematically showing the exposure device disclosed in Japanese Published Patent Application No. 2006-187895. In this exposure device 311, for example, the arrays of the organic EL light emitting elements 303A and 303B, are formed so that in each line of the arrays an area of a light emitting pixel for each of the organic EL light emitting elements is the same. The areas of the light emitting pixel for the organic EL light emitting element are different from each other between the lines of the arrays. The area is an integer multiple of the smallest area. Accordingly, the exposure device disclosed in the Japanese Published Patent Application No. 2006-187895 can perform sixteen levels of exposure, including the minimum level in which none of the organic EL light emitting elements are selected (do not emit light).

However, in the exposure device disclosed in Japanese Patent No. 4552601, the light quantities from the organic light emitting element are the same, and the expression for N gray levels requires (N−1) lines, in the sub scanning direction, of arrays of organic EL light emitting elements. Furthermore, the number of the shift registers, which perform delay processing for data in the sub scanning direction, in the sub scanning direction is the same as the number of the light emitting elements.

In the exposure device disclosed in Japanese Published Patent Application No. 2006-187895, an expression of larger number of gray levels is possible with a lesser number of organic EL light emitting elements. However, in this exposure device, the resolution is constrained by the largest area of the organic EL light emitting element, and there is a problem that improvement of the resolution is difficult. Furthermore, when the pitch among the organic EL light emitting elements is uniform, all the organic EL light emitting elements are arranged with the pitch for the largest area of the organic EL light emitting elements. Accordingly, there is a problem that the size of the exposure device becomes large.

SUMMARY OF THE INVENTION

It is a general object of at least one embodiment of the present invention to provide an exposure device and an image forming apparatus that substantially obviates one or more problems caused by the limitations and disadvantages of the related art.

In one embodiment, an exposure device, which emits light according to a gray level of image data, includes plural light emitting element lines arranged at different positions in a sub scanning direction, a number of the light emitting element lines being a number of bits representing a number of gray levels. Each of the light emitting element lines includes plural light emitting elements arranged in a line in a direction parallel to a main scanning direction; in the light emitting elements, the numbers of layers of organic electro-luminescence light emitting elements are the same. The numbers of layers of the organic electro-luminescence light emitting elements laminated in the light emitting element lines, which are arranged at different positions in the sub scanning direction, are different from each other.

In another embodiment, an image forming apparatus includes an exposure device, which emits light according to a gray level of image data, including plural light emitting element lines arranged at different positions in a sub scanning direction, the number of the light emitting element lines being a number of bits representing a number of gray levels, each of the light emitting element lines including plural light emitting elements arranged in a line in a direction parallel to a main scanning direction, in which light emitting elements the numbers of layers of organic electro-luminescence light emitting elements are the same; an image forming unit that develops a toner image on a photoreceptor exposed by the exposure device by using toner; a paper transportation unit that transports a paper to a position where the toner image formed by the image forming unit is transferred onto the paper; and a transfer unit that transfers the toner image onto the paper. The numbers of layers of the organic electro-luminescence light emitting element laminated in the light emitting element lines, which are arranged at different positions in the sub scanning direction, are different from each other.

According to the embodiments of the present invention, an exposure device is provided that suppresses increase in a number of light emitting elements in the sub scanning direction and increase in a size of a control circuit while increasing a number of gray levels, without changing areas of organic EL light emitting elements.

BRIEF DESCRIPTION OF THE DRAWINGS

Other objects and further features of embodiments will, be apparent from the following detailed description when read in conjunction with the accompanying drawings, in which:

FIG. 2 is a table illustrating an example of a gray level expression according to the present embodiment;

DESCRIPTION OF THE PREFERRED EMBODIMENTS

In the following, embodiments of the present invention will be described with reference to the accompanying drawings.

Figure 1:
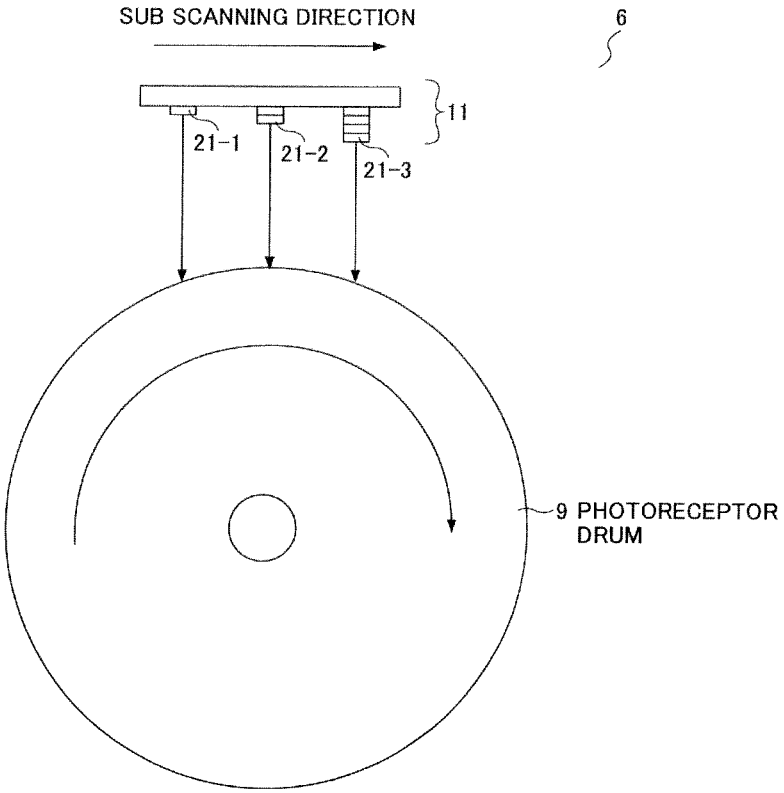
FIG. 1 is an explanatory diagram schematically illustrating an example of a feature of an exposure device according to a present embodiment.

FIG. 1 is an explanatory diagram schematically illustrating an example a feature of a light emitting element array according to the present embodiment. The light emitting element array 11 corresponds to an exposure device in claims. In FIG. 1, three light emitting elements 21 are arranged in a line in the sub scanning direction. The three light emitting elements 21 expose the same position in the main scanning direction. In the following, the three light emitting elements 21 will be denoted as the light emitting elements 21-1, 21-2 and 21-3, respectively.

In the present embodiment, the light emitting element array has a feature that in the light emitting elements 21 layers of light emitting elements are laminated according to the MPE (Multi-Photon Emission) method. The MPE method is one of the methods of laminating plural layers of light emitting elements wherein layers of light emitting units are laminated in series via a charge generation layer. By laminating n layers of light emitting elements according to the laminating method of the related art, n times the luminance of one light emitting element can be obtained. The laminated layers of light emitting elements according to the MPE method include a charge generation layer, and several times of the luminance by an electric current for one organic EL light emitting element can be obtained. In other words, in order to obtain the same luminance, only a fraction of the electric current for one organic EL light emitting element is enough.

In the present embodiment, the layers of light emitting elements are laminated according to the MPE method. However, the present invention is not limited to this. Even if the light emitting element according to the laminating method of the related art is employed, the light emitting element can emit light of high luminance without increasing an area.

As shown in FIG. 1, the light emitting elements 21-1, 21-2 and 21-3 are formed by laminating one layer, two layers and four layers of light emitting elements, respectively. Furthermore, the light emitting elements 21-1, 21-2 and 21-3, arranged in a line in the main scanning direction are called light emitting element lines. The light emitting element lines including the light emitting elements 21-1, 21-2, 21-3 will be denoted as the light emitting element lines 26-1, 26-2, 26-3, in the following. The number of gray levels of image data can be specified by a number of gray level bits N. For eight gray levels, the number of gray level bits N is three. The number of the light emitting elements 21 in the sub scanning direction is equal to the number of gray level bits N, i.e. three in the present embodiment.

The number of layers of each light emitting element 21 is two to the $i^{th}$ power, i.e. $2^{i-1}$. In the present embodiment, the number of layers of the light emitting elements 21-1, 21-2 and 21-3 are one, two and four, respectively. That is, ratios of exposure amounts from the light emitting elements 21-1, 21-2 and 21-3 are one, two and four, respectively.

Each of the light emitting elements is controlled to "emit light (ON)" or "not emit light (OFF)". According to the multiple exposure of luminance from the three light emitting elements 21-1, 21-2 and 21-3, the gray level expression having eight levels 0 to 7 becomes possible.

FIG. 2 is a diagram illustrating an example of the gray level expression. The exposure device according to the present embodiment includes three kinds of light emitting elements 21-1, 21-2 and 21-3, the luminances of light from which are different from each other. That is, the gray level expression having eight (i.e. $2^3$) levels becomes possible.

According to the present embodiment, in the light emitting element array, plural light emitting elements 21 expose the same point on the photoreceptor drum 9, and sufficient light quantity can be obtained. The gray level can be controlled by selecting a light emitting element to emit light from the light emitting elements 21, and a configuration of the control circuit can be made simple. If the light emitting elements are not laminated as in the related art, the number of the light emitting elements is $2^N-1$ for the gray level expression with $2^N$ gray levels. On the other hand, in the present embodiment, the number of the light emitting elements is N, which is far less than the related art, i.e. $2^N-1$. Accordingly, the number of the light emitting elements can be suppressed by employing the N laminated light emitting elements. The area, which the light emitting elements occupy, is reduced, and the size of the exposure device can be reduced.

[Example of Configuration]

Figure 3:
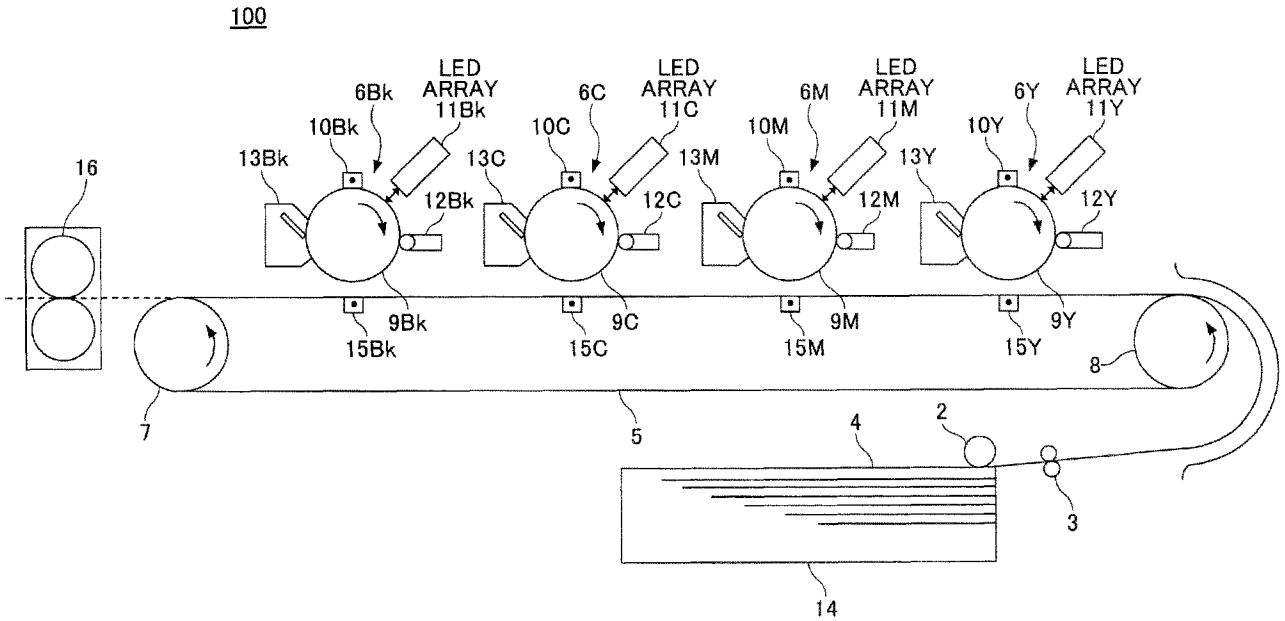
FIG. 3 is a diagram illustrating an example of a configuration of an image forming apparatus according to the present embodiment.

FIG. 3 is a diagram illustrating an example configuration of an image forming apparatus according to the present embodiment. The image forming apparatus 100 includes image forming units 6Y, 6M, 6C and 6Bk for respective colors, arranged along a transportation belt 5, which is an endless transportation means. This configuration of the image forming units is called "tandem type". Other configurations of the image forming units may be possible, such as a four cycle type, in which four toner images of respective colors are transferred in series to an intermediate transfer unit, and the four toner images are transferred to a paper at once. The present invention is not limited to the configuration illustrated in FIG. 3.

In a paper feed tray 14, sheets of paper 4 are accommodated. The sheets of paper 4 may be recording media, such as sheets of film. A sheet of paper 4 is picked up from the paper feeding tray 14 by a pick-up roller 2, fed by a feeding roller 3, and transported by the transportation belt 5. The sheet of paper 4 is stuck to the transportation belt 5 by a negative pressure or static electricity.

The plural image forming units (electrophotographic processing units) 6Y, 6M, 6C and 6Bk are arranged in this order from the upstream side of the transportation belt 5. The plural image forming units 6Y, 6M, 6C and 6Bk have the same internal configuration, except for the color of the toner image to be formed. The image forming unit 6Bk forms a black image. The image forming unit 6C forms a cyan image. The image forming unit 6M forms a magenta image. The image forming unit 6Y forms a yellow image. In the following, the image forming unit 6Y will be specifically explained. The explanation for the other image forming units 6M, 6C, and 6Bk is the same as for the image forming unit 6Y. The elements in the image forming units 6M, 6C and 6Bk are shown in the drawings, in which the reference signs Y are replaced by M, C and Bk, respectively. The explanations for the image forming units 6M, 6C and 6Bk are omitted.

The transportation belt 5 is an endless belt, which is wound around a driving roller 7, which is rotationally driven, and around a driven roller 8. The driving roller 7 is rotationally driven by a driving motor (not shown). The driving motor, the driving roller 7 and the driven roller 8 function as drive means that circulate the transportation belt 5, which is the endless transportation means.

The sheet of paper, stuck to the transportation belt 5, is transported to the first image forming unit 6Y by the transportation belt 5, which is rotationally driven. Onto the sheet of paper, a yellow toner image is transferred. The image forming unit 6Y includes a photoreceptor drum 9Y as a photoreceptor. The image forming unit 6Y further includes a charge unit 10Y, a light emitting element array 11Y, a development unit 12Y, a photoreceptor cleaner 13Y and an electric neutralizer not shown) arranged around the photoreceptor drum 9Y. The light emitting element arrays 11Y, 11M 11C and 11Bk are exposure devices which expose the image forming units 6Y, 6M, 6C and 6Bk, respectively.

A periphery of the photoreceptor drum 9Y is uniformly charged by the charge unit 10Y in the dark, exposed by the irradiation light corresponding to a yellow image from the light emitting element array 11, and an electrostatic latent image is formed. The development unit 12Y visualizes the electrostatic latent image by using yellow toner, and forms a yellow toner image on the photoreceptor drum 9Y. The toner image is transferred to the sheet of paper 4 by an action of an electrostatic force of the transfer unit 15Y at a position where the photoreceptor drum 9Y contacts the sheet of paper on the transportation belt 5 (transfer position). By the above transfer, an image is formed by the yellow toner on the sheet of paper 4. Unnecessary residual toner on the periphery of the photoreceptor drum 9Y, which has finished the transfer of the toner image, is wiped off by the photoreceptor cleaner 13Y. The photoreceptor drum 9Y is neutralized by the electric neutralizer, and waits for the next image formation.

The sheet of paper 4, on which the yellow toner image is transferred, is transported by the transfer belt 5 to the next image forming unit 6M. In the image forming unit 6M, a magenta toner image is formed on the photoreceptor drum 9M according to the same process as in the image forming unit 6Y. The magenta toner image is transferred to the sheet of paper 4, superposing the yellow toner image on the sheet of paper 4. The sheet of paper is further transported to the next image forming units 6C and 6Bk. In the same way as above, the cyan toner image formed on the photoreceptor drum 9C and the black toner image formed on the photoreceptor drum 9Bk are transferred onto the sheet of paper 4 superposing the other images. According to the above processes, a full-color image is formed on the sheet of paper 4. The sheet of paper 4, on which the full-color superposed image is formed, is detached from the transportation belt 5. After the image on the sheet of paper is fixed by a fixing unit 16, the sheet of paper is discharged from the image forming apparatus 100.

Figure 4:
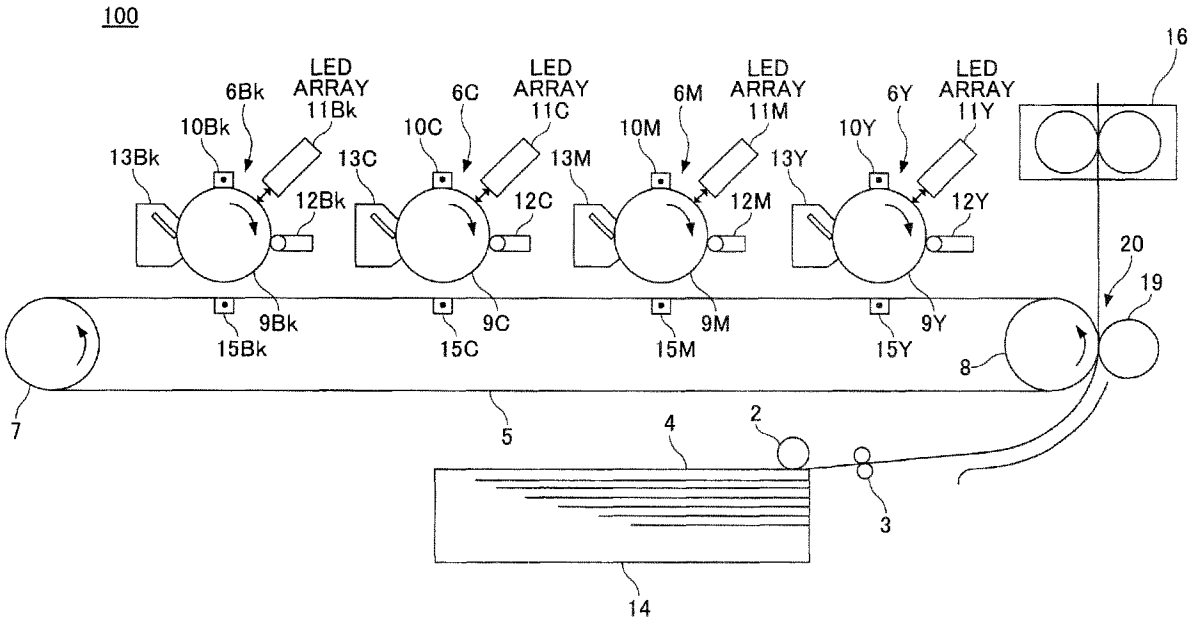
FIG. 4 is a diagram illustrating another example of the configuration of the image forming apparatus according to the present embodiment.

FIG. 4 is a diagram illustrating another example of the configuration of the image forming apparatus 100 according to the present embodiment. In FIG. 3, a toner image is formed directly on the sheet of paper 4. In FIG. 4, a toner image is formed on an intermediate transfer belt (the transportation belt 5). That is, the transportation belt 5, which is the endless transportation means in FIG. 3, is the intermediate transfer belt 5 in FIG. 4. The intermediate transfer belt 5 is an endless belt, which is wound around a driving roller 7, which is rotationally driven, and around a driven roller 8.

The toner images of the corresponding colors are transferred onto the intermediate transfer belt 5 (primary transfer) at positions where the photoreceptor drums 9Y, 9M, 9C and 9Bk contact the intermediate transfer belt 5 (primary transfer position) by the actions of the transfer units 15Y, 15M, 15C and 15Bk, respectively. According to the above operations, a full-color age, including toner images of respective colors, which superpose each other, is formed on the intermediate transfer belt 5.

When the image is formed, sheets of paper 4 accommodated in the paper feed tray 14 are sent sequentially from the uppermost sheet 4. The full-color toner image is transferred to the sheet of paper 4 (secondary transfer) at a position where the intermediate transfer belt 5 contacts the sheet of paper 4 (secondary transfer position 20). At the secondary transfer position 20, a secondary transfer roller 19 is arranged. The transfer efficiency is enhanced by pressing the sheet of paper 4 to the intermediate transfer belt 5 according to the secondary transfer roller 19 as well as the electrostatic force. The secondary transfer roller 19 may always contact the intermediate transfer belt 5, or by a contact/separation mechanism the secondary transfer roller 19 may contact the intermediate transfer belt 5 only during the secondary transfer.

In FIGS. 3 and 4, the process of forming an image on the sheet of paper is described. The present invention is not limited to the above process. The image forming apparatus 100 may be equipped with at least one of a function of a scanner which scans a manuscript, a function of copier which scans the manuscript and prints out the scanned image, and a function of a facsimile apparatus which transmits/receives document data via a telephone line or the Internet. Such an image forming apparatus 100 is called an MFP (Multi Function Peripheral).

Figure 5:
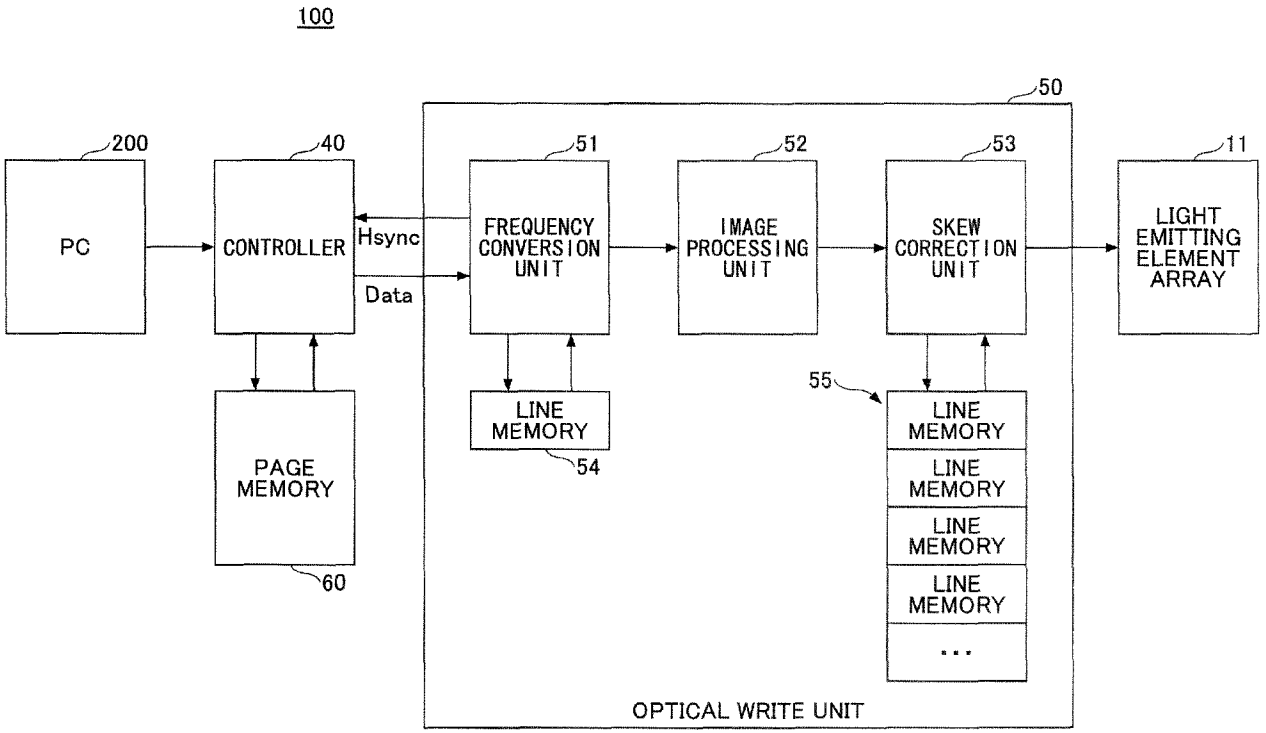
FIG. 5 is an explanatory diagram illustrating an optical write unit according to the present embodiment.

FIG. 5 is an explanatory diagram illustrating an optical write unit 50, which outputs image data to the light emitting element array 11, according to the present embodiment. When a PC (Personal Computer) 200 issues a print instruction along with print data, a controller 40 converts the print data into bitmap data, and stores the bitmap data into a page memory 60. The optical write unit outputs to the controller 40 a HSYNC (horizontal synchronizing) signal. The controller 40 transmits bitmap data of one line to the optical write unit 50 at the timing of the output of the HSYNC signal. For the above process of transmission, an image forming method, which can process data in different formats for each channel (CH) may be employed. Furthermore, another image forming method, which can process only data in a common format between channels (CH) may be employed.

In the above process, since operation clock frequencies are not the same, in general, between the optical write unit 50 and the controller 40, the image data is stored in a line memory 54. A frequency conversion unit 51 converts the frequency for operation of reading the bitmap data based on the operation clock of the optical write unit 50.

After the above process, an image processing unit 52 performs image processing, such as an addition of an internal pattern (an image, which is not included in the image data, such as stamp printing, woven pattern printing, a line pattern in CMYK for color tone correction, a pattern for gray level correction or the like is added in this stage), and trimming processing, and sends bitmap data to a skew correction unit 53. For a process requiring a line memory for a jaggy correction in the image processing, the image processing unit 52 may include a line memory for image processing.

The bitmap data is stored in the multi-line memory 55 for skew correction. The skew correction unit 53 performs a skew correction, when the bitmap data are read out from the multi-line memory 55, at each point in the main scanning direction, by shifting the multi-line memory 55 in the sub scanning direction, which is read out for a time determined by a register for the skew correction.

The optical write unit 50 controls an emission of the light emitting element array 11 according to the image data after the skew correction. That is, the gray level expression is possible by selectively causing the light emitting elements 21 having different luminance levels to emit light, according to the gray level.

[Light Emitting Element Array]

Figure 6:
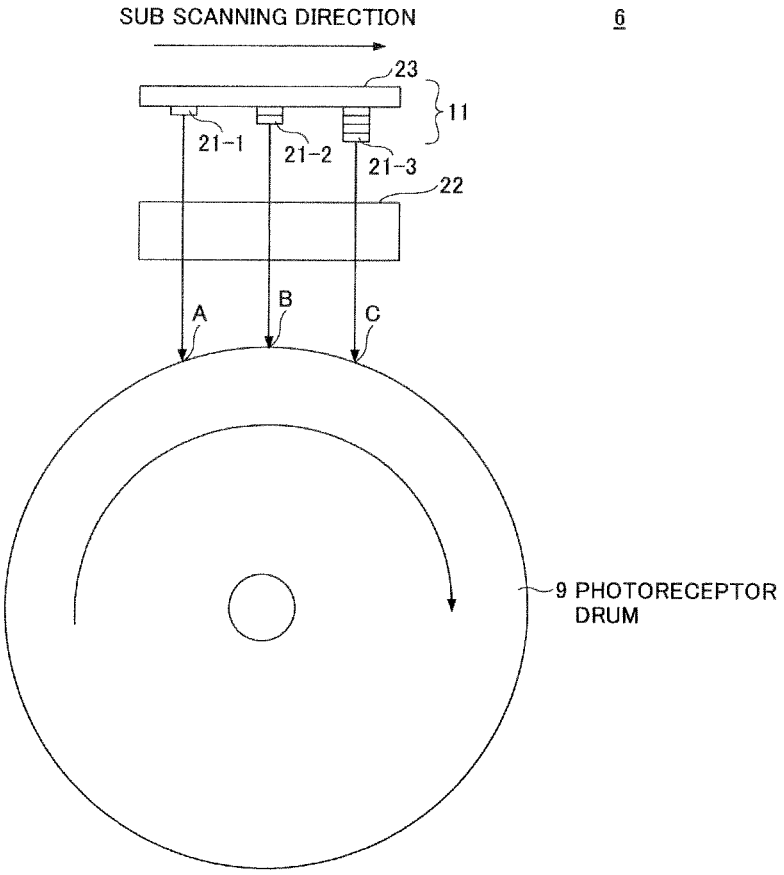
FIG. 6 is a diagram illustrating an example of a configuration of the exposure device according to the present embodiment.

FIG. 6 is a diagram schematically illustrating an example of the configuration of the light emitting element array 11 according to the present embodiment. FIG. 6 shows a main part of the light emitting element array 11 according to the present embodiment for explanation. The image forming unit 6 includes the light emitting element array 11, a lens array which focuses the light from the light emitting element array 11, and a control circuit arranged on a substrate 23. The light from the light emitting element array 11 through the lens array 22 is irradiated onto the photoreceptor drum 9.

The light emitting element array 11 and the lens array 22 are integrated to form a line head module, so that a relative position is fixed. The lens array 22 focuses the light from the light emitting element array 11 and forms an upright image of the same size on the photoreceptor drum 9. The control circuit on the substrate 23 is integrated with the organic EL light emitting elements.

Figure 7:
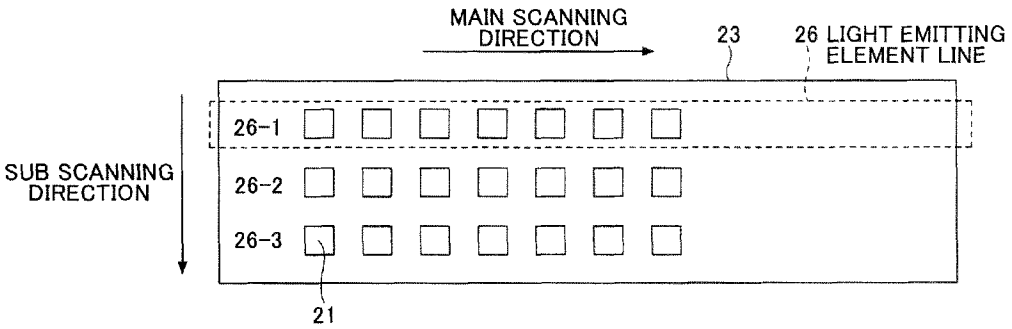
FIG. 7 is a diagram schematically illustrating an example of a front view of the light emitting element array according to the present embodiment.

FIG. 7 is a diagram schematically illustrating an example of a front view of the light emitting element array 11. The light emitting elements 21, in which one or more organic EL light emitting elements are laminated, are arranged in lines on the substrate 23. The plural light emitting elements arranged in a line in the main scanning direction form a light emitting element line 26, including the light emitting elements, the number of which is the number of the pixels. Accordingly, the number of the light emitting elements included in one light emitting element line 26 corresponds to a resolution of several hundreds to several thousands dpi (dots per inch).

In the light emitting element array 11 according to the present embodiment, N light emitting element lines, 26-1 to 26-N, are arranged in the sub scanning direction. In FIG. 7, N is three. N is a number of bits which represent a number of gray levels.

The light emitting element 21 is formed by using the MPE method, and has a configuration in which one or more layers of organic EL light emitting elements are laminated in series. Compared with the organic EL light emitting element of the single layer structure, the light emitting element 21 according to the present embodiment can radiate brighter light by the same electric current. An exposure amount by each of the light emitting elements 21 is preferably proportional to the number of the layers of the organic EL light emitting elements, if the luminance of one layer of organic EL light emitting element is constant. Since the luminance of the light emitted from the organic EL light emitting element is generally determined by the electric current for the Light emitting element, even if a quantity of the luminance of the organic EL light emitting element is not proportional to the number of the layers, the quantity of luminance of the light emitting element having the same number of layers (i.e. the light emitting element in the same light emitting element line) can be made constant. However, if the luminance of the organic EL light emitting element is proportional to the number of the layers, since it is not necessary for the exposure amount to be electrically corrected, a correction circuit is not necessary, and the area of the substrate and the cost can be reduced.

As shown in FIG. 6, the light emitting element array 11 is arranged so that a light emitting surface faces the photoreceptor drum 9 and the direction of the light emitting element line is in parallel with the rotational axis of the photoreceptor drum 6. A pitch between the light emitting elements in the main scanning direction is constant. Moreover, a pitch between the light emitting elements in the sub scanning direction is also constant. Accordingly, positions of the light emitting elements 21 in the main scanning direction in the respective light emitting element lines 26-1 to 26-3 are the same. The light emitting elements 21 in the respective light emitting element lines 26-1 to 26-3 expose the same position in the main scanning direction. In FIG. 7, the pitch between the light emitting elements in the main scanning direction and the pitch between the light emitting elements in the sub scanning direction are constant. However, these pitches may not be constant. Moreover, if another light emitting element array 11 having the same configuration is arranged shifting in the main scanning direction, a resolution in the main scanning direction can be easily enhanced.

The number of layers and an area of each light emitting element 21 will be explained in the following. In the present embodiment, the area and the number of layers of each of the light emitting elements 21 included in one light emitting element line are constant. For example, the number of layers of all the light emitting elements 21 included in the light emitting element line 26-1 is one. The number of layers of all the light emitting elements 21 included in the light emitting element line 26-2 is two. The number of layers of all the light emitting elements 21 included in the light emitting element line 26-3 is four. Moreover, the area of all the light emitting elements 21 included in the light emitting element line 26-1 is S. The area S is designed according to a luminance required for the exposure. The area of all the light emitting elements 21 included in the light emitting element line 26-2 is S. The area of all the light emitting elements 21 included in the light emitting element line 26-3 is S. Accordingly, comparing the number of layers of the light emitting elements 21 neighboring in the sub scanning direction, the numbers of layers are different.

The number of layers of the organic EL light emitting element in the light emitting element line **26-*i* is two to the $i^{th}$ power, i.e. $2^{i-1}$. The number of the light emitting element line is denoted by i, which indicates an order of the number of the layers in ascending order. Accordingly, the number of layers of the light emitting element line 26-1, as the first line, is one. The number of layers of the light emitting element line 26-2, as the second line, is two. The number of layers of the light emitting element line 26-3**, as the third line, is four. In this way, the light emitting elements in each of the light emitting element lines include layers of the organic EL light emitting elements, the number of which is specified by a power-of-two.

The order of the number of the layers is not limited to the ascending order. The order of the number of the layers may be a descending order, or may be arranged randomly.

Moreover, the number of the light emitting element lines in the sub scanning direction may be N, which is the number of gray level bits. That is, in the case of three bits in order to express eight gray levels, the number of the light emitting element lines is three. Moreover, in the case of four bits in order to express sixteen gray levels, the number of the light emitting element lines is four. Furthermore, in the case of eight bits in order to express 256 gray levels, the number of the light emitting element lines is eight.

[Method of Controlling Gray Level]

Figure 8:
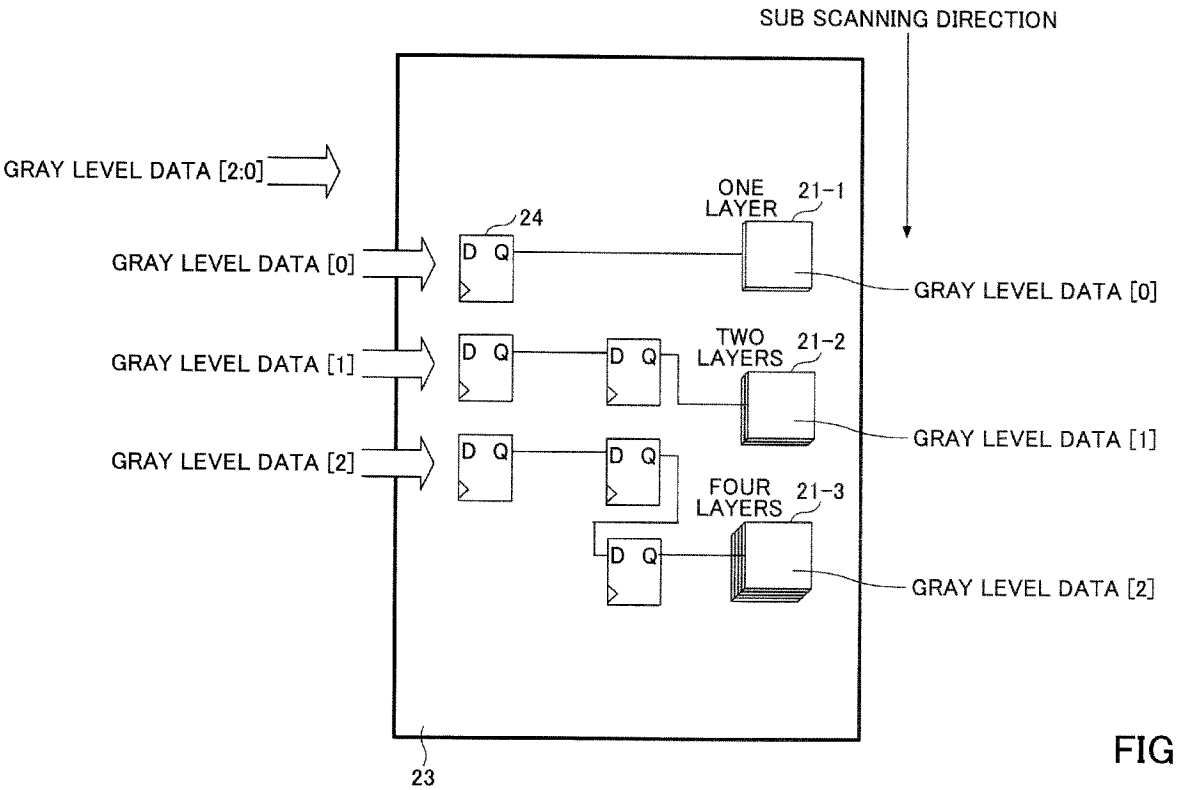
FIG. 8 is a diagram illustrating an example of a configuration of a control circuit for the light emitting element array including an organic EL light emitting element which expresses eight gray levels according to the present embodiment.

FIG. 8 is a diagram illustrating an example of a control circuit of the light emitting element array 11 including organic EL light emitting elements in the case of expressing eight gray levels according to the present embodiment. With reference to FIG. 8, the method of controlling eight gray levels will be explained in the following. For each pixel in the main scanning direction, a gray level is given by controlling each light emitting element in the sub scanning direction in two states, i.e. emit light or not emit light. The gray level data, which are expressed by N bits data, are provided, for each bit (in a unit of bit), to the light emitting element corresponding to the number of layers of the organic EL light emitting element. In the present embodiment, the zero-th bit of the gray level data is output to a light emitting element in the first line. The first bit of the gray level data is output to a light emitting element in the second line. The second bit of the gray level data is output to a light emitting element in the third line. According to the gray level data, which are expressed by three bits data, zero to three light emitting elements of the three light emitting elements in the sub scanning direction emit light. Since the three light emitting elements expose the same point on the photoreceptor drum, the exposure amount in the drawing region is a sum of exposure amounts from the light emitting elements in the sub scanning direction. Accordingly, the gray level expression, a number of which is specified by a power-of-two (in the present embodiment, two to the third power, i.e. eight gray levels) can be easily realized. In this way, the gray level can be changed by the multiple exposures.

For example, as shown in FIG. 6, an exposure is performed to the drawing region A from the light emitting elements in the first line, i.e. the light emitting element line 26-1. Then, the photoreceptor drum 9 rotates, and the drawing region A moves in the sub scanning direction relatively against the light emitting element array 11. From the light emitting elements in the second line, i.e. the light emitting element line 26-2, the exposure performed on the drawing region B. Furthermore, the photoreceptor drum 9 rotates, and the drawing region B moves in the sub scanning direction relatively against the light emitting element array 11. In the same way as above, the exposure is performed on the drawing region C from the light emitting elements in the third line, i.e. the light emitting element line 26-3. In this way, the multiple exposures are performed. As in the present embodiment, when the light emitting element array 11 includes three light emitting element lines, the multiple exposures up to three times can be performed.

Even though exposure amount from one organic EL light emitting element is insufficient, by the multiple exposures from plural organic EL light emitting elements to the same point, a sufficient exposure amount can be obtained. Accordingly, supplying high electric current to one organic EL light emitting element in order to obtain a required exposure amount becomes unnecessary, and a long period of endurance of the organic EL light emitting element, the life of which may be shortened by supplying a high electric current, can be ensured.

The control circuit controls the light emitting elements 21-1, 21-2 and 21-3, to "emit light (ON)" or "not emit light (OFF)", as follows:

For the gray level data "000", 21-1 is OFF, 21-2 is OFF and 21-3 is OFF;

For the gray level data "001", 21-1 is ON, 21-2 is OFF and 21-3 is OFF;

For the gray level data "010", 21-1 is OFF, 21-2 is ON and 21-3 is OFF;

For the gray level data "011", 21-1 is ON, 21-2 is ON and 21-3 is OFF;

For the gray level data "100", 21-1 is OFF, 21-2 is OFF and 21-3 is ON;

For the gray level data "101", 21-1 is ON, 21-2 is OFF and 21-3 is ON;

For the gray level data "110", 21-1 is OFF, 21-2 is ON and 21-3 is ON; and For the gray level data "111", 21-1 is ON, 21-2 is ON and 21-3 is ON.

That is, if the zero-th bit is 0, the light emitting element 21-1 is OFF. If the zero-th bit is 1, the light emitting element 21-2 is ON. If the first bit is 0, the light emitting element 21-2 is OFF. If the first bit is 1, the light emitting element 21-2 is ON. If the second bit is 0, the light emitting element is OFF. If the second bit is 1, the light emitting element is ON.

[Reduction of Circuit]

Next, a reduction of the circuit will be explained, in the following. At first, the reduction of circuit in the related art will be explained for comparison.

Figure 9:
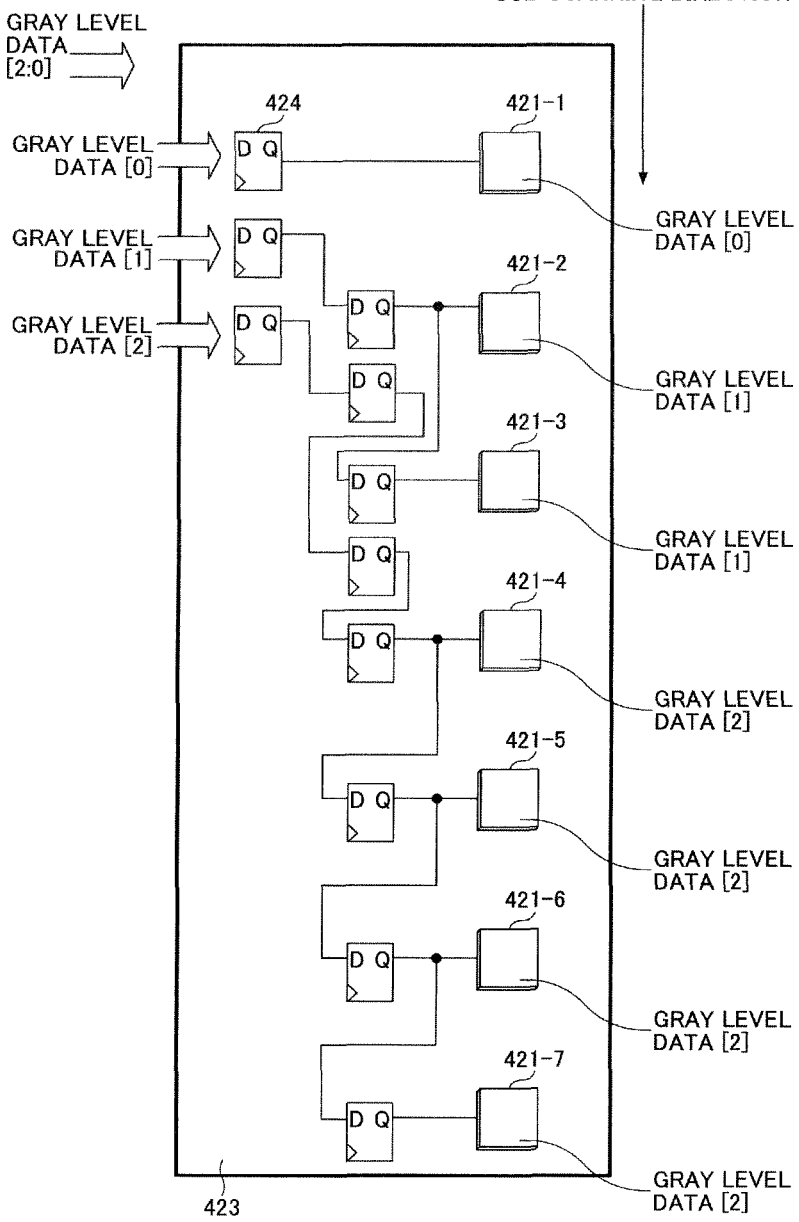
FIG.9 RELATED ART
FIG. 9 is a diagram illustrating an example of a configuration of a control circuit for the light emitting element array including an organic EL light emitting element with one layer which expresses eight gray levels according cc the related art.
Figure 10A:
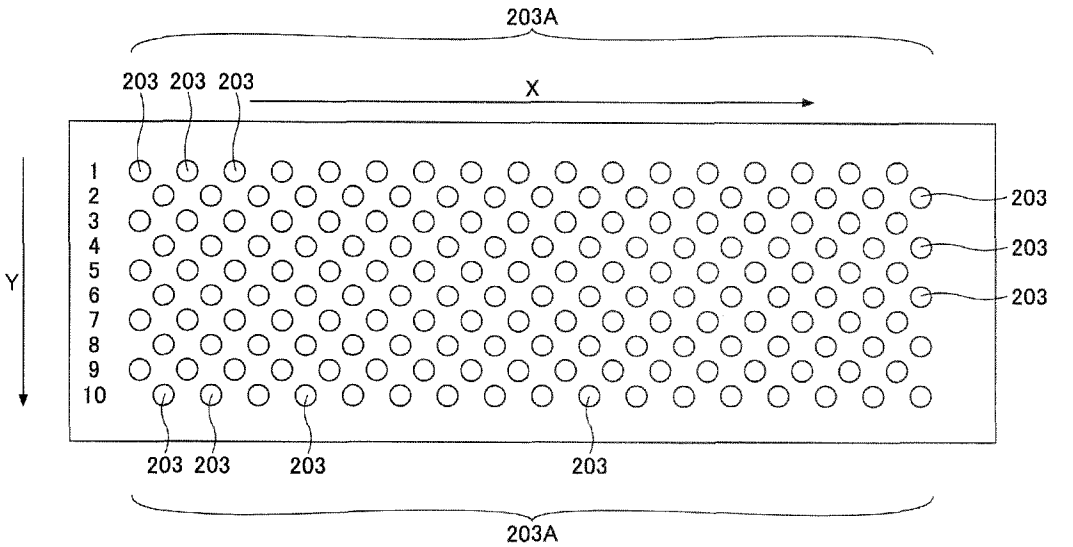
FIG.10A RELATED ART
FIGS. 10A and 10B are diagrams schematically illustrating the line heads according to the related art.
Figure 10B:
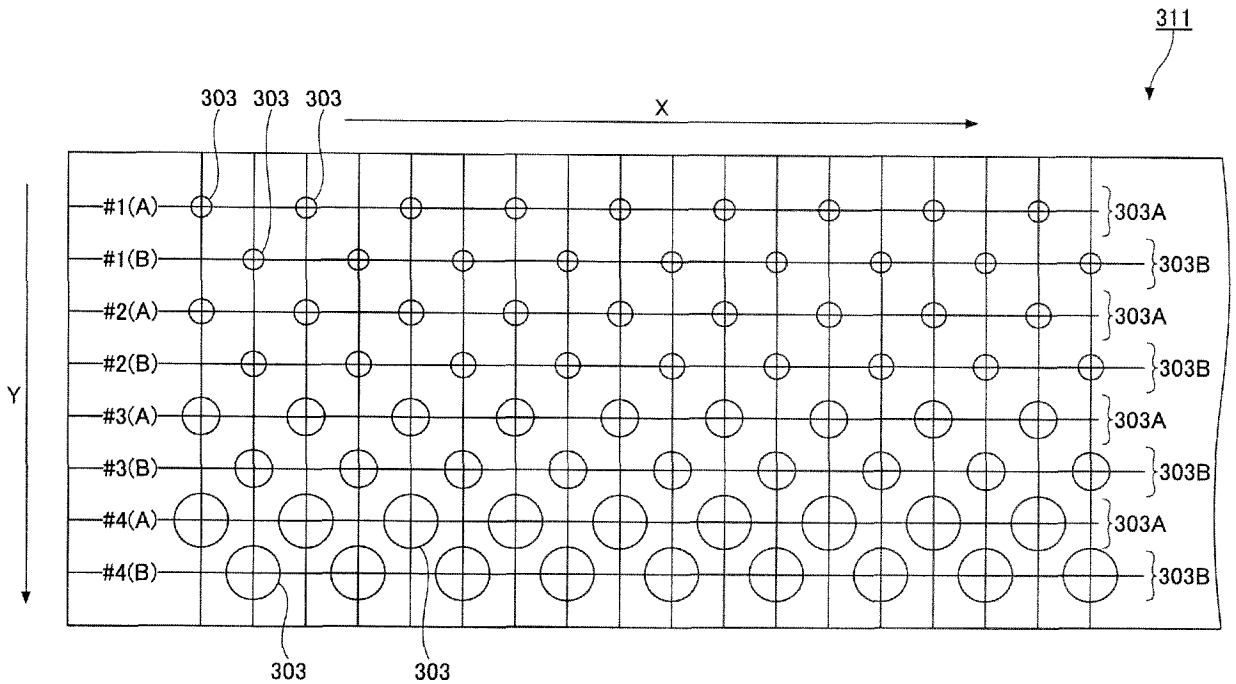
FIG.10B RELATED ART

FIG. 9 is a diagram illustrating an example of the control circuit of the light emitting element array 11 including organic EL light emitting elements with one layer which expresses eight gray levels according to the related art. The gray level data are expressed by three bits data, i.e. 000 to 111, which are represented as [2:0]. In order to express gray levels, the number of which is two to the N-th power, by the N bits gray level data, the number of the necessary light emitting elements is $2^N-1$. As shown in FIG. 9, for expressing the eight gray levels, seven light emitting elements are necessary. In the following, indices 421-1 to 421-7 for identification are assigned to the light emitting elements, respectively.

The light emitting element array 411 outputs the gray level data to the light emitting elements, the number of which corresponds to the weight of bit, i.e. the digit. The weight of bit is two to the k-th order, wherein k is a position of digit of bit. The lowest (zero-th) digit [0] of the gray level data has a weight of bit of one, and is output to one light emitting element 421-1. The first digit [1] of the gray level data has a weight of bit of two, and is output to two light emitting elements 421-2 and 421-3. The second digit [2] of the gray level data has a weight of four, and is output to four light emitting elements 421-4 to 421-7.

Furthermore, the outputs of the gray level data are delayed in the ascending order from the small weight of bit by flip-flops (light emitting control circuit) 424. Including the flip-flops 424, which receive the input of the gray level data, the light emitting element 421-1 requires one step of delay, the light emitting element 421-2 requires two steps of delay, the light emitting element 421-3 requires three steps of delay, the light emitting element 421-4 requires four steps of delay, the light emitting element 421-5 requires five steps of delay, the light emitting element 421-6 requires six steps of delay, and the light emitting element 421-7 requires seven steps of delay. In this way, in the case that the number of gray level bits is three, the number of the required flip-flops 24 is 2ΠN−1. In the case that N is three, the number of flip-flops 24 is eleven, i.e. $2\times(1\cdot2\cdot3)-1=11$.

FIG. 8 is a diagram illustrating an example of the light emitting element array 11 according to the present embodiment. In FIG. 8, the light emitting element array 11 outputs the gray level data to the light emitting elements, the number of layers of which corresponds to the weight of bit, i.e. the digit. The lowest (zero-th) digit [0] of the gray level data has a weight of bit of one, and is output to the light emitting element 21-1 with one layer. The first digit [1] of the gray level data has a weight of bit of two, and is output to the light emitting element 21-2 with two layers. The second digit [2] of the gray level data has a weight of bit of four, and is output to the light emitting element 21-3 with four layers.

Moreover, the outputs of the gray level data are delayed by a flip-flop 24, so that the light emitting elements emit light in the ascending order from the small weight of bit. Including the flip-flops receiving the input of the gray level data, the light emitting element 21-1 with one layer requires one step of delay, the light emitting element 21-2 with two layers requires two steps of delay, and the light emitting element 21-3 with four layers requires three steps of delay.

In this way, in the light emitting element array 11 according to the present embodiment, in order to perform the gray level expression where the number of gray level bits is N, the number of the light emitting elements is N. In FIG. 8, the light emitting element array 11 includes three light emitting elements, since the number of gray level bits is three. Moreover, the light emitting element 21-1 requires one flip-flop, the light emitting element 21-2 requires two flip-flops, and the light emitting element 21-3 requires three flip-flops. Accordingly, the light emitting element array 11, which expresses the gray level where the number of gray level bits is N, requires the flip-flops, the number of which is a sum of k, where k is an integer from 1 to N, i.e. $N(N+1)/2$. In the case that N is three, the number of the required flip-flops is six, as shown in FIG. 8.

In this way, in the light emitting element array 11 according to the present embodiment, the size of the control circuit can be reduced, compared with the light emitting element array 411 of the related art. Moreover, since the number of the light emitting elements is less than that of the related art, the size of the light emitting element array can be reduced. Accordingly, flexibility of configuration of the image forming apparatus 100 can be enhanced.

As explained above, the light emitting element array 11 according to the present embodiment includes the light emitting element lines (i=1, . . . , N) arranged in the sub scanning direction, where the number of gray level bits is N. The light emitting element in the i-th light emitting element line has $2^{i-1}$ layers of organic EL light emitting elements. Light emitting elements are selected from the light emitting elements in the sub scanning direction, each of which belongs to the light emitting element line 26-1, . . . or 26-N, according to the gray level data. The selected light emitting elements, the number of which varies zero to N, emit light, and the multiple exposure at the same point on the photoreceptor drum 9 is performed. The number of the light emitting element lines according to the present embodiment is the number of the gray level bits N, which is far less than the number of gray levels $2^N$. Accordingly, the size of the light emitting element array 11 according to the present embodiment can be reduced compared with the light emitting element array of the related art, which requires $2^N-1$ light emitting element lines, and the size of the control circuit can be reduced. Moreover, the light emitting element 21 according to the present embodiment is preferably laminated according to the MPE method, and the light emitting element 21, to which an approximately constant electric current is supplied, can emit light, the luminance of which is proportional to the number of layers.

Further, the present invention is not limited to these embodiments, but various variations and modifications may be made without departing from the scope of the present invention.

The present application is based on and claims the benefit of priority of Japanese Priority Application No. 2013-045869 filed on Mar. 7, 2013, with the Japanese Patent Office, the entire contents of which are hereby incorporated by reference.

What is claimed is:

1. An exposure device, which emits light according to a gray level of image data, comprising:

a plurality of light emitting element lines arranged at different positions in a sub scanning direction, the number of the light emitting element lines corresponding to a number of bits for representing gray levels, each of the light emitting element lines including:

a plurality of light emitting elements arranged in a line in a direction parallel to a main scanning direction, each light emitting element amongst the plurality of light emitting elements in the line having been laminated with a same number of layers of organic electro-luminescence light emitting elements as that of the others amongst the plurality of light emitting elements in the line, wherein the number of layers of the organic electro-luminescence light emitting elements laminating a light emitting element in one line amongst the plurality of light emitting element lines is different than that of a light emitting element in another line amongst the plurality of light emitting element lines.

2. The exposure device as claimed in claim 1, wherein in all the light emitting elements included in the i-th light emitting element line, a number of the layers of the organic electro-luminescence light emitting element being expressed by two raised to a power of the (i-1)-th order, where i is a natural number greater than or equal to one, are laminated.

3. The exposure device as claimed in claim 2, wherein the light emitting element is laminated according to a MPE (Multi-Photon Emission) method.

4. The exposure device as claimed in claim 2, further comprising a control circuit that outputs image data, which is input in a unit of bits, to the light emitting elements in the light emitting element line, which correspond to positions of bits, wherein the control circuit delays an output bit according to a position of arrangement of the light emitting element line in the sub scanning direction, and the control circuit performs a control, for each bit, to make the light emitting element in the light emitting element line corresponding to the bit emit light when the bit is ON, and to make the light emitting element in the light emitting element line corresponding to the bit not emit light when the bit is OFF.

5. The exposure device as claimed in claim 4, wherein the control circuit includes flip-flop circuits, a number of which is a sum of integers from one to the number of the light emitting element lines.

6. The exposure device as claimed in claim 1, wherein for each light emitting element line amongst the plurality of light emitting element lines, the number of layers of the organic electro-luminescence light emitting elements laminating each of the plurality of light emitting elements in the light emitting element line is different from that of each of the other light emitting element lines.

7. An image forming apparatus, comprising:

the exposure device as claimed in claim 1;

an image forming unit that develops an image on a photoreceptor exposed by the exposure device by using a toner;

a paper transportation unit that transports a paper to a position where a toner image formed by the image forming unit is to be transferred onto the paper; and a transfer unit that transfers the toner image onto the paper.

* * * * *